US005603464A

United States Patent [19]

Watabe et al.

[11] Patent Number: 5,603,464

[45] Date of Patent: Feb. 18, 1997

[54] LOW ABRASION RESISTANCE FIBER CAKE AND METHOD OF MANUFACTURING THE SAME

[75] Inventors: Kenzo Watabe; Takehiro Matsumoto, both of Koriyama; Mitsuo Tanji, Fukushima; Keizo Yamashita; Tadashi Endo, both of Koriyama, all of Japan

[73] Assignee: Nitto Glass Fiber Mfg. Co., Ltd., Koriyama, Japan

[21] Appl. No.: 559,803

[22] Filed: Nov. 17, 1995

Related U.S. Application Data

[63] Continuation of Ser. No. 99,094, Jul. 28, 1993, abandoned.

[30] Foreign Application Priority Data

Aug. 6, 1992 [JP] Japan ..... 4-210085

[51] Int. Cl.[6] ..... B65H 18/28; B65H 54/00

[52] U.S. Cl. ..... 242/165; 242/18 G; 242/167

[58] Field of Search ..... 242/27.1, 18 G, 242/18 PW, 159, 166, 167, 165, 178

[56] References Cited

U.S. PATENT DOCUMENTS

| | | | |
|---|---|---|---|
| 691,816 | 1/1902 | Smith | 242/165 |
| 1,091,046 | 3/1914 | DeWolf | 242/166 |
| 1,614,420 | 1/1927 | Brown et al. | 242/165 |
| 1,960,128 | 5/1934 | Snow | 242/178 |
| 3,064,481 | 11/1962 | High et al. | 242/18 G |
| 3,297,155 | 1/1967 | Gattenby, Jr. et al. | 242/159 |
| 4,085,901 | 4/1978 | Sanders | 242/18 G |
| 4,088,282 | 5/1978 | Day | 242/159 X |
| 4,239,162 | 12/1980 | Barch et al. | 242/18 G X |
| 4,342,430 | 8/1982 | Kasai et al. | 242/18 G X |
| 4,511,095 | 4/1985 | Ideno et al. | 242/18 G |
| 4,696,438 | 9/1987 | Myers | 242/159 X |
| 4,830,647 | 5/1989 | Watabe | 242/18 G X |
| 5,220,632 | 6/1993 | LoStracco | 242/166 X |

FOREIGN PATENT DOCUMENTS

| | | | |
|---|---|---|---|
| 75348 | 6/1981 | Japan | 242/165 |
| 58-30864 | 7/1983 | Japan . | |
| 3-72549 | 11/1991 | Japan . | |
| 1038422 | 8/1966 | United Kingdom . | |

OTHER PUBLICATIONS

Japanese Abstract No. 60–262775 Dec. 26, 1995.
Japanese Abstract No. 62–230570.

*Primary Examiner*—Michael R. Mansen
*Attorney, Agent, or Firm*—Darby & Darby

[57] ABSTRACT

A cake of glass fibers or the like has a waste yarn which is provided by winding a strand, which continues from an end yarn extending in contact with a winding tube, on the winding tube to cover the end yarn before a usual winding work for forming a cake on the winding cube. This cake can prevent filaments from being broken by rubbing of the strand in the innermost layer of the cake with the end yarn which is pulled into the cake when the end yarn is cut after the stand is completely wound on the winding tube.

12 Claims, 4 Drawing Sheets

LOW ABRASION RESISTANCE FIBER CAKE AND METHOD OF MANUFACTURING THE SAME

BACKGROUND OF THE INVENTION

This is a continuation of application Ser. No. 08/099,094, filed Jul. 28, 1993, now abandoned.

1. Field of the Invention

The present invention relates to a low abrasion resistance fiber cake, and particularly to a glass cake which permits production of a glass yarn, a glass roving and a glass cloth with high yield.

2. Description of the Prior Art

As well known, hundreds of filaments are formed by drawing, at high speed, molten glass flowed out through hundreds orifices formed in the bottom of a bushing. and sizing agent is then applied to the filaments. Then, the filaments are gathered into at least one strand by passing the filaments through a gathering device. The thus-formed strand is wound on a winding tube by a winding apparatus to form a glass cake. At the time of use, the cake is unwound in either of two methods. One of the methods is a method in which the winding tube is removed after the cake has been heated and dried for a predetermined time, and the strands are drawn out from the insides or outsides of a plurality of cakes. Then, a predetermined number of the strands are paralleled to be wound up by a winder so that a glass roving is formed. As an alternative to this, the strands are supplied to a cutter to be formed into chopped strands. In another method, after the cake is dried naturally for a predetermined time, the strand is drawn out from the outer portion of a cake, and is twisted by a rewinding twister to form a glass yarn. The glass yarn is wound around a bobbin so as to be used in a glass cloth.

FIG. 4 shows an example of conventional apparatuses for producing glass cakes. In this example, molten glass flowed out from a bushing 1 having 400 orifices formed in the bottom surface thereof is drawn at a high speed of 3000 m/min to form 400 filaments 2 each having a diameter of about 7μ. These filaments 2 are then divided into two groups, a sizing agent is then applied to each of the filament groups by a sizing agent applicator 3. The filaments of each group are then gathered by a gathering device 4 to form one strand 5 having 200 filaments. The strand 5 is then wound on a winding tube 9 fitted on a collet 7 of a winding apparatus (not shown) while being traversed by a rotation type traversing device 6 (cam type traverse) to form a cake 11.

In the above glass cake producing apparatus, at the start of winding of the strand to form the cake, the strands 5 are guided to the front end portion of the collet 7 by a yarn guide (not shown) and is temporarily wound at the end portion. The strand temporarily wound as shown by reference numeral 8 is called a temporarily wound strand. When the yarn guide is removed after the rotation of the collet 7 becomes stationary, the strand 5 is moved to a position where it engages with a wire of the traversing device 6 by its own tension, and is wound on the tube 9 while being traversed by the wire. Generally, a least two strands are wound on one collet to form two cakes for improving the productivity. When two cakes are formed, as shown in FIG. 4, two strands 5 are tangled and temporarily wound on the front end portion of the collet to form the temporarily wound strand 8 at the start of winding. When the yarn guide is removed after the rotation of the collet becomes stationary, the strands are separated into two end yarns 10. The end yarns 10 are respectively moved to positions of engagement with the traversing wires, and are pressed by the innermost layers of the two cakes 11 formed on the winding tube 9.

At the time of doffing after the strands are completely wound to form cakes, the end yarn 10 which connects the temporarily wound strand 8 and the front cake 11, and the end yarn 10 which connects the two cakes 11 are cut. At this time, since the end yarns 10 are pulled, the end yarns 10 are slid on the innermost layer of the cakes 11, and the filaments are thus partially broken due to rubbing of the strands in the innermost layer of the cakes 11. If the cut end yarns are somewhat long, when the yarns are cut in the next stage, the filaments are broken by same cause as that described above.

When a predetermined number of strands are paralleled to be wound by a winder so that a glass roving is formed, as described above, or when a strand is twisted by a twister and wound as a glass yarn on a bobbin, the filaments which are broken by the above-described cause are separated from the strands to form lagging yarns, thereby breaking of the strands or the roving formed. The breakage of the filaments causes fuzz and thus a critical quality problem. Even when the broken filaments are buried in the stands and thus causes neither broken strand nor fuzz, the broken filaments are peeled off in a next weaving process and cause thinning of the strands, thereby causing a critical quality problem with respect to stripbacks or the like.

When a cake is produced, as shown in FIG. 4, a strand to be wound approaches the traversing wire rotation axis as the strand is being wound to enlarge the cake, and the stroke of the traverse movement is gradually increased as the turning points of the traverse movement are moved to the large-diameter sides at both ends of the wire. Namely, the winding width of the strand increases as the cake size increases with winding. This state is schematically shown in FIG. 5A–5D. As shown in FIGS. 5A, 5B, 5C and 5D the end yarn contacts not only the strands in the innermost layer but also the all strands which are successively wound while increasing the winding width to finally form a cake, as shown in FIG. 5D. When the end yarns are cut, therefore, the filaments are broken over the whole range of the cake.

When a plurality of strands are drawn and paralleled to be wound by a winder to form a glass roving, or when a strand is twisted by a twister and wound as a glass yarn on a bobbin, the strands in the innermost layer are generally left behind for protecting the filaments from flaws in the surface of the winding tube. However, this conventional method cannot solve the problem caused by cutting the end yarns because breakage of filaments occurs in not only the strands in the innermost layer but also in the strands over the whole cake, as described above.

SUMMARY OF THE INVENTION

In order to solve the above problem, a cake of the present invention is characterized in that an end yarn which is pulled in contact with a winding tube is covered with a waste yarn which is successively wound on a predetermined portion of the winding tube before a strand is wound on the winding tube to form a cake.

The waste yarn for covering the end yarn is preferably wound over the whole length of the tube or at least one end thereof. When the waste yarn is provided over the whole length of the winding tube, the waste yarn is formed by moving the end yarn to a traversing position and then winding a strand, which continues from the end yarn, on the winding tube using a wire rotation type traversing device while reciprocating a traverse at a lower speed and with a larger width than those in formation of a cake before a usual traversing action of forming a cake by the cooperation of the wire rotation type traversing device and the traverse. When the waste yarn is provided at one end of the winding tube, the waste yarn is formed by positioning the wire rotation type traversing device to confront the end of the winding tube, stopping the traverse, and then winding the strand which continues from the end yarn, on the winding tube using the wire rotation type traversing device only. Namely, the leading portion of the waste yarn is connected to the end yarn, and the tailing portion is connected to the cake. The winding amount of the waste yarn is determined so as to prevent the transmission of the friction and abrasion, which are caused when the position of the end yarn with respect to the winding tube is shifted due to application of tension to the end yarn.

In the cake of the present invention, since a portion of the end yarn which contacts the innermost layer of the cake is covered with the waste yarn, the frictional function of the end yarn, which is caused when the end yarn is cut, has no effect on the cake, thereby preventing the occurrence of filament breakage and flaws in the cake. As a result, broken filaments, stripbacks or broken strand caused by lagging yarns can be significantly decreased during the production of the cake.

DESCRIPTION OF THE PREFERRED EMBODIMENTS

Figure 1A:
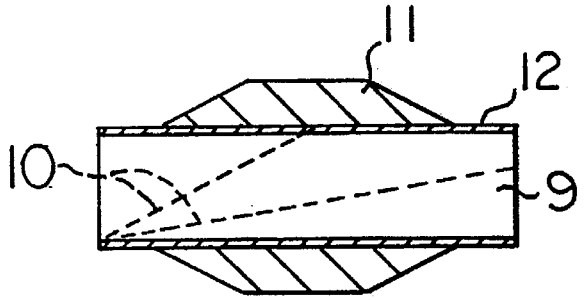
FIGS. 1A, 1B, 1C and 1D are respectively sectional views of cakes according to various embodiments of the present invention.
Figure 1B:
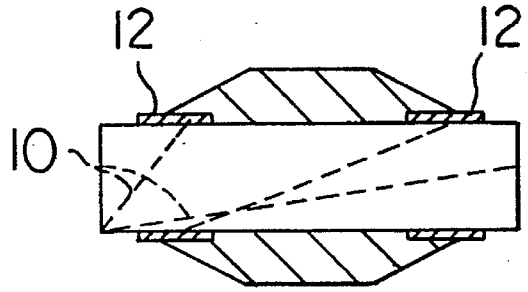
Figure 1C:
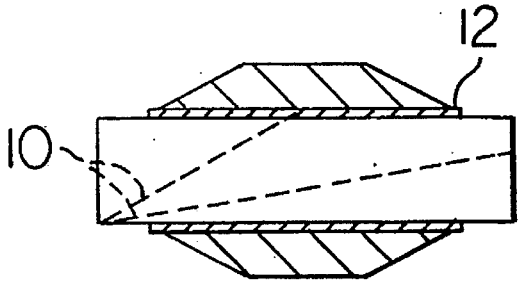
Figure 1D:
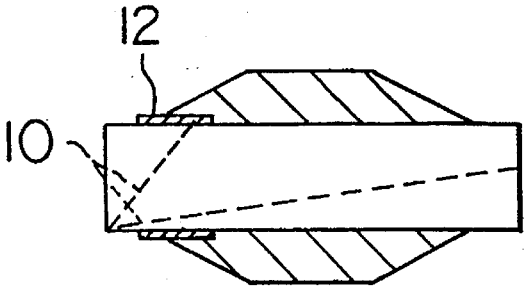

FIGS. 1A–1D show cakes according to various embodiments of the present invention. FIG. 1A shows a cake where a waste yarn 12 is provided over the whole length of a winding tube 9, FIG. 1B shows a cake where the waste yarn 12 is provided on portions near both ends of the winding tube, FIG. 1C shows a cake where the waste yarn is provided over substantially the whole length without both end portions of the winding tube, and FIG. 1D shows a cake where the waste yarn 12 is provided only in a portion near one end of the winding tube.

Figure 2:
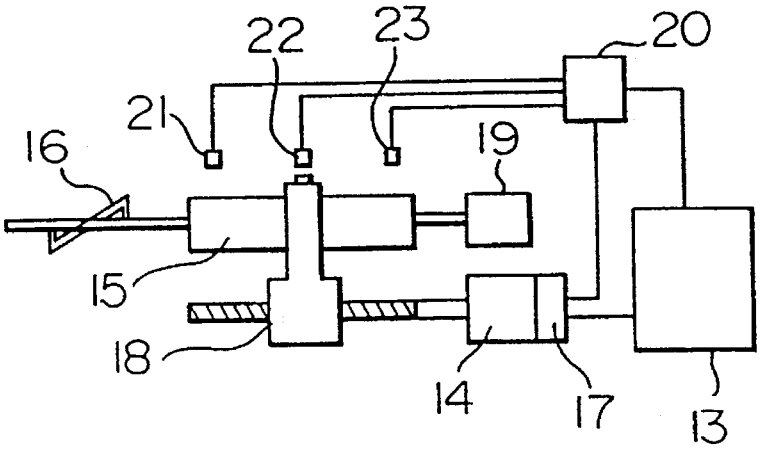
FIG. 2 is a schematic drawing showing a traversing mechanism for forming a cake of the present invention.
Figure 3A:
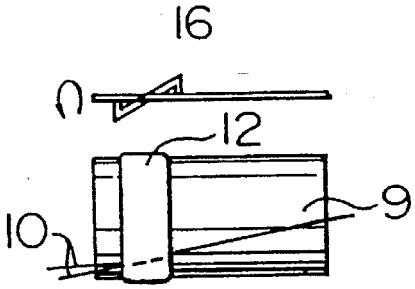
FIGS. 3A, 3B and 3C are drawings explaining the process of forming a cake according to the present invention.
Figure 3B:
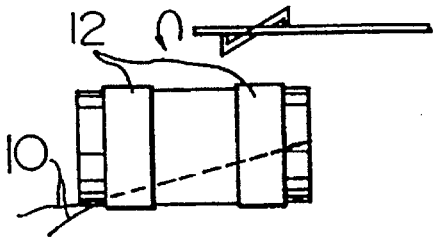
Figure 3C:
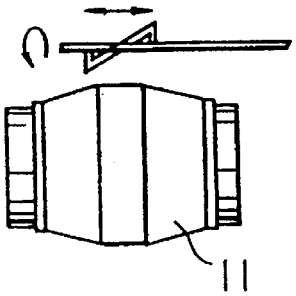
Figure 4:
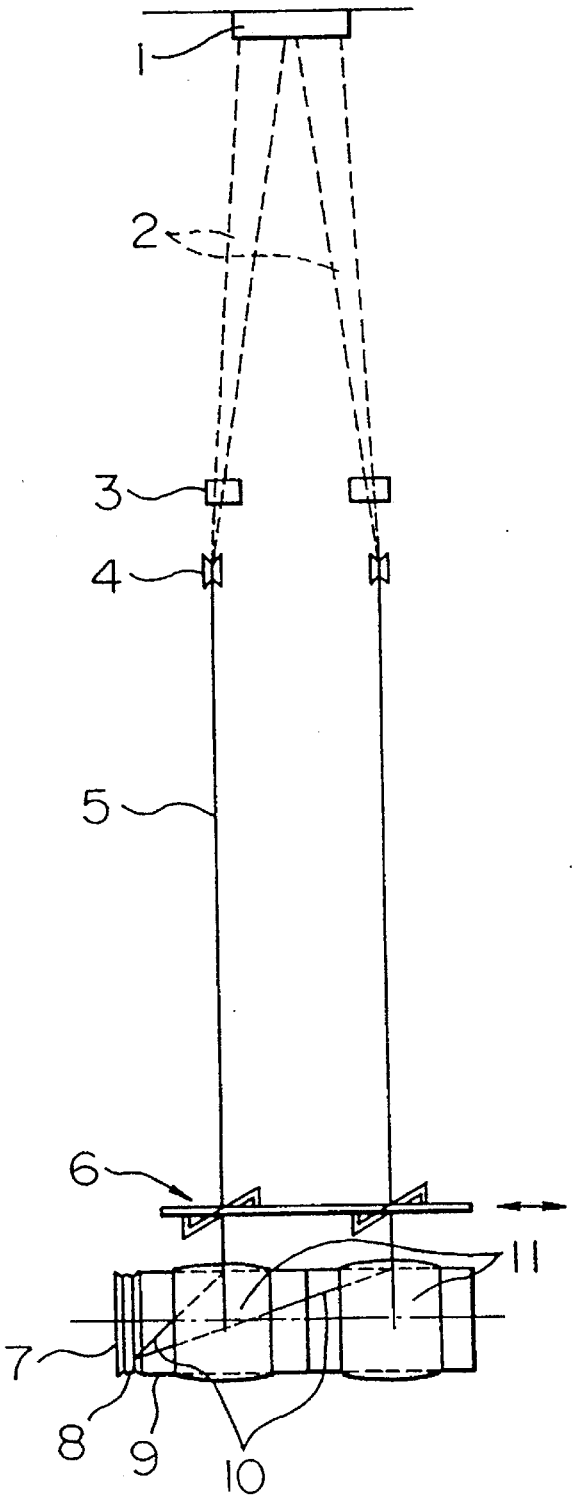
FIG. 4 PRIOR ART
FIG. 4 is a schematic drawing showing a conventional cake producing apparatus.
Figure 5A:
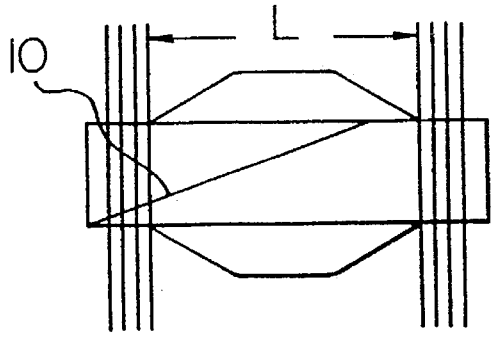
FIG. 5A PRIOR ART
FIGS. 5A, 5B, 5C and 5D are drawings showing a conventional process of forming a cake.
Figure 5B:
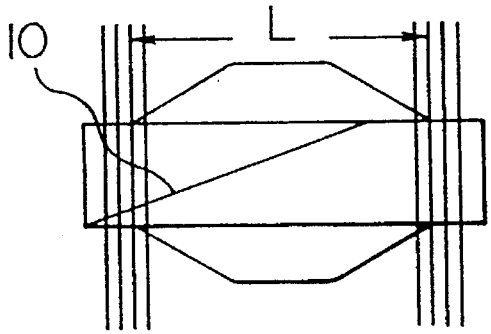
FIG. 5B PRIOR ART
Figure 5C:
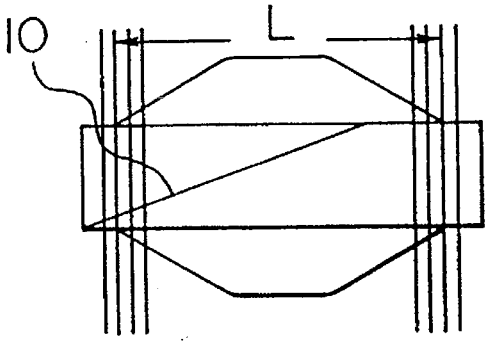
FIG. 5C PRIOR ART
Figure 5D:
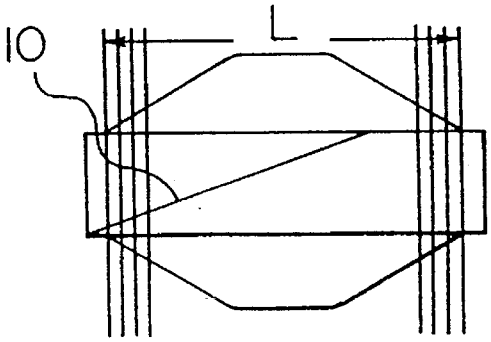
FIG. 5D PRIOR ART

FIG. 2 shows a traversing mechanism used for forming a cake of the present invention. When the cake shown in FIG. 1B is formed, a traverse servo motor 14 is operated by instructions from a sequencer 13, and a traverse 15 is forwardly moved to a position at a distance of about 10 ram from a usual position and stopped at this position. A wire 16 (only one in the mechanism shown in FIG. 2) of a wire rotation type traversing device is then rotated so that the strand supplied to the wire 16 and continuing from the end yarn 10 which is drawn out from the temporarily wound strand 8 by the method described above with reference to FIG. 4, is wound as the waste yarn 12 on a portion near the front end of the winding tube 9 for 12 seconds while being traversed by the wire 16 which rotates at a predetermined position, as shown in FIG. 3A. The traverse servo-motor 14 is then reversed by instructions from the sequencer 13 so that the traverse 15 is moved backward to a position at a distance of about 10 ram from the usual portion. After the traverse 15 is stopped at this position, the waste yarn 12 is wound on a portion near the rear end of the winding tube 9 for 12 seconds while the wire 16 is rotated, as shown in FIG. 3B. In the final stage, the traverse servo-motor 14 is operated by instructions from the sequencer 13 so that the strand is wound on the winding tube 9 having the waste yarn 12 provided on the front and rear portions thereof while being traversed by rotating the wire 16 while the traverse 15 is traversed at a usual traverse position to form the cake 11 shown in FIG. 3C.

When the cake shown in FIG. 1A is formed, the traverse servo-motor 14 is operated by instructions from the sequencer 13 so that the strand is wound over the whole length of the winding tube 9 while being traversed by rotating the wire 16 while the traverse 15 is traversed at a lower speed than a usual speed and with a greater traverse width than a usual traverse width to form the waste yarn 12 over the whole length. The traverse 15 is then traversed at the usual speed and with the usual traverse width by instructions from the sequencer 13 so that the strand is wound on the waste yarn 12 while being traversed by the wire 16 to form the cake. In the mechanism shown in FIG. 2, reference numeral 17 denotes an encoder; reference numeral 18, a ball screw; reference numeral 19, a wire rotating motor; reference numeral 20, a terminal box; and reference numeral 22, a sensor for detecting a reference position of the movement of the traverse 15. Reference numerals 21 and 23 each denote a sensor for preventing excessive movement.

Each of the cakes obtained by a conventional method and the method of the present invention was rewound while giving a twist of 1Z. Table 1 shows the rate of broken strand produced on rewinding, and Table 2 shows the rate of broken filaments on the surface of each of the products obtained. Table 3 shows the rate of stripbacks in the glass cloth woven by using as a weft each of the products.

TABLE 1

Broken Strand Rate in Rewinding Process

| | Number of measure-ments | Number of broken strands | Rate of broken strand (%) |
|---|---|---|---|
| Conventional cake | 6,946 | 430 | 6.19 |
| This invention cake | 3,281 | 49 | 1.49 |

TABLE 2

Broken Filament Rate in Rewinding Process

| | Number of measure-ments | Number of broken filaments | Rate of broken filament (%) |
|---|---|---|---|
| Conventional cake | 90,518 | 6,432 | 7.11 |
| This invention cake | 7,047 | 142 | 2.02 |

(Note) Criterion for broken filaments: at least one broken filament on the surface of one product

TABLE 3

| Number of Stripbacks per meter in Weaving Process | | | |
|---|---|---|---|
| | Measurement length (m) | Number of stripbacks | Number of stripbacks per meter |
| Conventional cake | 5,567,750 | 215 | 0.0000386 |
| This invention cake | 444,430 | 1 | 0.0000023 |

As obvious from the above tables, the cake of the present invention comprising the waste yarn provided in the innermost layer thereof exhibits extremely low broken strand rate, broken filament rate and stripback rate, as compared with the conventional cake without the waste yarn.

Although the present invention is particularly effective for glass fibers as object materials, the present invention is also effective for low abrasion resistance fibers, e.g., organic fibers such as acrylic fibers, pitch carbon fibers, rayon fireproof fibers and the like; ceramic fibers such as boron fibers, silicon carbide fibers, alumina fibers, silica fibers and the like; inorganic fibers such as asbestos fibers and the like; metal fibers such as stainless fibers and the like, all of which are easily cut by abrasion or friction.

With respect to the size of the fibers which form yarns of a strand, roving, tow or the like, the present invention is particularly effective for thin fibers, for example, glass fibers having a diameter of 7 μM or less.

Although the winding tube is made of a material paper, plastic, a metal or the like, the present invention is particularly effective for a cake formed using a plastic tube which is easily damaged. In addition, since a cake with a greater winding amount exhibits higher tightness and easily causes filament breakage, the present invention is effective for a large cake.

The cake of the present invention preferably has a trapezoid half sectional form, as shown in FIGS. 1A–1D and the present invention is particularly effective for a cake formed by using a wire rotation type traversing device in a winding apparatus.

What is claimed is:

1. A method of producing a low abrasion resistance fiber cake comprising:

temporarily winding a strand comprising low resistance fibers on a front end portion of a collet;

moving the strand to a position which causes the strand to engage with a traversing device to form an end yarn extending along a winding tube fitted on the collet from a distal end of the winding robe to a first predetermined axial position between a midpoint and the distal end of the winding tube;

traversing the strand that is continuous from the end yam by the traversing device to form a waste yarn wound on the winding robe between said first predetermined axial position and a second predetermined axial position which is adjacent to said distal end of the winding tube to cover at least a part of said end yam; and winding the strand that is continuous from said waste yam on the winding tube while axially reciprocating said traversing device to form a cake such that an innermost strand layer of said cake in at least one end portion of said cake, on the side of said distal end, is in contact with said waste yam and is spaced from said end yarn.

2. A method of producing a low abrasion resistance fiber cake according to claim 1, wherein the low abrasion resistance fibers are glass fibers.

3. A method of producing a low abrasion resistance fiber cake according to claim 2, wherein the diameter of the glass fibers is 3.2 to 7.5 μm.

4. A method of producing a low abrasion resistance fiber cake according to claim further comprising a second strand of low resistance fibers on the front end portion of the collet together with said first strand;

moving the second strand to another position which causes the second strand to engage with a second traversing device to form a second end yam extending along the winding tube fitted on the collet from the distal end to a proximal end on the winding tube;

traversing the first strand that is continuous from said first waste yam by the first traversing device which has been axially displaced to a position confronting a portion of the winding tube near the proximal end thereof to form a second waste yam wound on said portion of the winding tube to cover at least a part of said second end yam, wherein said cake is continuous from said second waste yarn, wherein said cake is continuous from said second waste yarn and wound on the winding tube such that an innermost strand layer of said cake in another end portion thereof is in contact with said second waste yarn and is spaced from said second end.

5. A low abrasion resistance fiber cake comprising:

an end yarn comprising of a strand which extends, under tension, along a winding tube from a distal end of the winding tube to a first predetermined axial position between a midpoint and the distal end of the winding tube;

a waste yarn comprising of said strand that is continuous from said end yarn and wound on the winding tube between said first predetermined axial position and a second predetermined axial position on the distal end side of the winding tube to cover at least a part of said end yarn; and a cake comprising of said strand that is continuous from said waste yarn and wound on the winding tube such that an innermost strand layer of said cake in at least one end portion of said cake, on the side of said distal end, is in contact with said waste yarn and is spaced from said end yarn.

6. A low abrasion resistance fiber cake according to claim 5 wherein half of the cake has a substantially trapezoid sectional form.

7. A low abrasion resistance fiber cake according to claim 5, wherein the strand comprises a plurality of low abrasion resistance glass fibers.

8. A low abrasion resistance fiber cake according to claim 7 wherein the diameter of the glass fibers is 3.2 to 7.5 μm.

9. A low abrasion resistance fiber cake according to claim 5, wherein said waste yarn has a predetermined axial length and said cake has a predetermined axial length.

10. A low abrasion resistance fiber cake according to claim 9, wherein said waste yarn's axial length is different than said cake's axial length.

11. A low abrasion resistance fiber cake according to claim 5, wherein said waste yarn covers substantially all of said end yarn.

12. A low abrasion resistance fiber cake according to claim 5 further comprising a second end yarn consisting of a second strand which extends, under tension, along the winding tube from said distal end to a proximal end on the winding tube.

* * * * *